US011583065B2

(12) United States Patent
Schiffer

(10) Patent No.: US 11,583,065 B2
(45) Date of Patent: Feb. 21, 2023

(54) TOOTHBRUSH

(71) Applicant: M+C Schiffer GmbH, Neustadt/Wied (DE)

(72) Inventor: Küros Schiffer, Neustadt/Wied (DE)

(73) Assignee: M+C Schiffer GmbH, Neustadt/Wied (DE)

( * ) Notice: Subject to any disclaimer, the term of this patent is extended or adjusted under 35 U.S.C. 154(b) by 393 days.

(21) Appl. No.: 16/765,242

(22) PCT Filed: Nov. 20, 2018

(86) PCT No.: PCT/EP2018/081852
§ 371 (c)(1),
(2) Date: May 19, 2020

(87) PCT Pub. No.: WO2019/101711
PCT Pub. Date: May 31, 2019

(65) Prior Publication Data

US 2020/0345128 A1 Nov. 5, 2020

(30) Foreign Application Priority Data

Nov. 21, 2017 (DE) ..... 10 2017 220 748.5

(51) Int. Cl.
*A46B 9/06* (2006.01)
*A46B 3/04* (2006.01)
(Continued)

(52) U.S. Cl.
CPC ..... *A46B 9/06* (2013.01); *A46B 3/04* (2013.01); *A46B 9/026* (2013.01); *A46B 9/028* (2013.01);
(Continued)

(58) Field of Classification Search
CPC .. A46B 9/06; A46B 3/04; A46B 9/026; A46B 9/028; A46B 9/04; A46B 15/0081; A46B 2200/1066; A46B 9/10; A46B 9/12; A46B 3/005; A46B 9/045; A46B 9/08; A46B 15/0055; A46B 2200/1026; A46B 2200/1073; A46B 2200/1086
(Continued)

(56) References Cited

U.S. PATENT DOCUMENTS 10,772,417 B2 * 9/2020 Lavezzo ..... A46B 7/023
2006/0057087 A1 3/2006 Moskovich et al.
(Continued)

FOREIGN PATENT DOCUMENTS

CN 203407678 U 1/2014
KR 2020130003421 U 11/2013
(Continued)

*Primary Examiner* — David J Walczak
(74) *Attorney, Agent, or Firm* — The Webb Law Firm

(57) ABSTRACT

A toothbrush includes an elongate handle stem and a brush head which is connected to the handle stem. The brush head carries a bristle array which contains a plurality of bristle bundles which, in order to improve the cleaning effect, in particular in the interdental spaces, have a plurality of bristle bundles attached to an outer edge of the bristle array, which have a diameter of between 0.8 and 1.2 mm and/or are formed from microfilaments with a diameter of 4 to 6 mils, the usage end of which tapers to a tip.

11 Claims, 3 Drawing Sheets

(51) Int. Cl.
*A46B 9/02* (2006.01)
*A46B 9/04* (2006.01)
*A46B 15/00* (2006.01)

(52) U.S. Cl.
CPC ..... *A46B 9/04* (2013.01); *A46B 15/0081* (2013.01); *A46B 2200/1066* (2013.01)

(58) Field of Classification Search
USPC ..... 401/268, 270, 282, 288, 291, 287
See application file for complete search history.

(56) References Cited

U.S. PATENT DOCUMENTS

| | | | | |
|---|---|---|---|---|
| 2008/0014010 | A1* | 1/2008 | Bartschi ..... | A46B 11/0003<br>401/282 |
| 2017/0020278 | A1 | 1/2017 | Xi et al. | |
| 2020/0397130 | A1* | 12/2020 | Ganninger ..... | A46B 15/0081 |

FOREIGN PATENT DOCUMENTS

| | | | |
|---|---|---|---|
| WO | 2006055574 | A2 | 5/2006 |
| WO | 2010119688 | A1 | 10/2010 |
| WO | 2015016306 | A1 | 2/2015 |
| WO | 2015085536 | A1 | 6/2015 |

* cited by examiner

TOOTHBRUSH

CROSS-REFERENCE TO RELATED APPLICATIONS

This application is the United States national phase of International Application No. PCT/EP2018/081852 filed Nov. 20, 2018, and claims priority to German Patent Application No. 10 2017 220 748.5 filed Nov. 21, 2017, the disclosures of each of which are hereby incorporated by reference in their entireties.

BACKGROUND

The present invention refers to a toothbrush with an elongate handle stem and a brush head connected to the handle stem, which carries a bristle array containing a plurality of bristle bundles.

Such brushes are generally known. There are various designs of bristle arrays, each of which should be optimized with regard to the desired cleaning effect.

SUMMARY OF THE INVENTION

The present invention is based on the problem of providing a brush whose cleaning effect is improved and which is particularly suitable for cleaning the interdental spaces in the context of dental care.

To solve this problem, the present invention proposes a toothbrush with the features described herein. The toothbrush according to the invention has specially formed bristle bundles at the outer edge of the bristle array. The bristle bundles have a diameter of between 0.8 mm and 1.2 mm. They may alternatively be formed of microfilaments with a diameter of between 4 and 6 mils, these microfilaments being tapered to a tip at their usage ends. Bristle filaments which are tapered to a tip in the sense of the present invention are in particular those filaments with a filament diameter of 4 mm to 6 mils, the usage end of which tapers continuously towards a tip over a length of between 2 mm to 8 mm. The tip is usually located in the center of the filament.

The bristle bundles, which have a diameter of between 0.8 mm and 1.2 mm, preferably 0.9 to 1.1 mm, particularly preferably 0.8 to 1.0 mm, i.e. bristles of small diameter, can penetrate the interdental spaces in a special way and clean them particularly effectively. The same applies to the microfilaments, which according to the invention have a very small diameter and are also tapered so that these microfilaments can easily penetrate into the interdental spaces.

The bristle bundles specially formed in this way and provided at the edges are usually made of PBT. They usually accommodate conventional bristle bundles formed from PA between them. These bristle bundles can form a bristle array on the brush head in a manner known per se. They usually consist of filaments with a diameter of 5 to 8 mils.

A bristle bundle consists of at least two filaments. The bristle bundles are usually held by an anchor on the brush head. As far as the present invention refers to the number and length of the filaments, this specification refers to the filament in the processed state. It is not decisive that two filaments are formed from a piece of filament approximately twice as long and are wound around the anchor. These two filaments formed from an identical piece of filament are two filaments in the sense of the present invention. The length of the filaments is the length which the filament has measured from the surface of the brush head through which the filament passes to the usage end of the filament.

The bristle bundles provided at the outer edge of the bristle array are usually of a different color than the usually conventional bristle bundles provided between the edge bristle bundles. These conventional bristle bundles may form an inner bristle array with the usage ends lying in a single plane. This makes it possible to place the usage ends of the inner bristle array flat against the teeth, while at the same time the bristle bundles provided at the outer edge of the bristle array, which preferably project at least with their tips beyond the usage ends of the inner bristle array, can penetrate into the interdental spaces. Preferably the bristle bundles provided according to the invention at the outer edge of the bristle array are provided circumferentially. In other words, all bristle bundles provided at the outer edge of the bristle array are provided with a diameter of between 0.8 mm and 1.2 mm and/or formed by microfilaments with a diameter of between 4 and 6 mils, in order to form, for example, a bristle bundle tapering to a tip at the usage end.

The microfilaments form a bristle bundle contoured at the usage end of the bristle bundle. They are tapered to a tip, i.e. the microfilaments do not have the same length. Rather, one or a few of the microfilaments are longer than the adjacent microfilaments. Usually the longer microfilaments are provided in the center of the bristle bundle. However, eccentric bristle bundles are also conceivable in which the microfilaments at the edge of the bristle filament have the greatest length extension and the adjacent microfilaments are shorter. In some examples, the usage ends of the bristle filaments, which are tapered to a tip on the usage end, are dyed.

The bristle bundle with a diameter of between 0.8 mm and 1.2 mm also preferably has a corresponding tapered contour in the sense discussed above. Thus, as a rule, few bristle filaments project over the usage ends of the inner bristle array and can effectively clean the interdental spaces when the usage ends of the filaments of the inner bristle array lie flat against the teeth, while in parallel the usage ends of the inner bristle array lie flat against the teeth and clean them.

Practical tests carried out by the applicant with a design in which all bristle bundles at the edges are formed in the manner described above have shown a considerably improved cleaning effect compared with conventional brushes with identical or similar bristle arrays.

The lower limit of the diameter of the small diameter bristle bundles is preferably 0.85 mm, especially preferred 0.9 mm. The upper limit of the diameter is preferably 1.05 mm, especially preferred 1 mm. Alternatively or in addition the microfilaments can have a diameter of 5 mils.

In so far as the bristle bundles at the edges of the bristles have been referred to above, this indication refers only to the arrangement of bristle bundles on the bristle head, these bristle bundles being formed by filaments. Generally, cleaning elements made of TPE are also known to be arranged on a brush head. Usually, these TPE cleaning elements, which may be additionally provided in the invention, are also provided by overmolding on a base body of the brush head. The cleaning elements are made of a soft-elastic component, preferably TPE. Such a soft-elastic overmolding can be provided on the outer circumference of the brush head in order to protect the sensitive gums when brushing the teeth and/or to form a tongue cleaner on the circumferential edge of the brush head or on the rear side of the brush head opposite the surface through which the bristle bundles project. For this purpose, the soft-elastic overmolding on the rear side preferably forms a profile which regularly has nubs and/or lamellae which can clean the tongue by scraping. The circumference of the brush head is usually formed by an edge of the brush head extending essentially at right angles to the surface through which the bristle bundles project. This edge connects the surface to the back of the brush head.

The soft-elastic overmolding can also form cleaning elements on the brush head. These cleaning elements project over the surface projected through by the bristle bundles. The soft-elastic cleaning elements can be provided on the edge of the brush head. Accordingly, the soft-elastic cleaning elements are sometimes located outside the bristle array and thus outside the bristle bundles provided at the outer edge of the bristle array. Soft-elastic cleaning elements can also be integrated into the bristle array. The soft-elastic cleaning elements are usually injected through indentations in the brush head at its edge and/or through holes in the brush head and are preferably connected to the brush head in a bonded or form-fit manner.

The soft-elastic material is usually injected via an injection point against a base body, which usually forms essential areas of the brush head and handle stem in one piece. This base body is made of a hard component, for example PA, PP or PE. The base body usually also forms the surface through which the bristle bundles project and accommodates anchors which attach the individual bristle bundles to the brush head. As already mentioned, the anchors attach at least the small diameter bristle bundles or the bristle bundles formed with the microfilaments. The conventional bristle bundles can also be fixed with anchors. Alternatively, the conventional bristle bundles can also be fixed to the brush head without anchors by first melting the conventional bristle bundles on the fixing side and then inserting them with the thickening thereby formed into a cavity which forms the base body. The bristle bundles are connected without an anchor to the base body, the plastic mass of which flows around the ends of the bristle bundles on the fixing side and seals the thickening in a form-fit manner.

The base body usually forms the skeleton of the brush body. A joint can be formed between the handle stem and the brush head. This is usually done by reducing the cross-section of the base body in such a way that a joint is formed between the brush head and the handle stem. This area with a reduced cross-section is preferably covered by the soft-elastic overmolding, so that an aesthetically pleasing appearance is achieved and it is also prevented that dirt and bacteria in the area of the joint adhere to the surfaces of the base body and settle in the area of the joint. The overmolding of the joint and the soft-elastic overmolding of the edge and/or the formation of the soft-elastic cleaning element is usually carried out by a uniform soft-elastic plastic material, by which all the aforementioned functional elements of the brush body are formed as a unit and connected to each other.

With regard to the desired improved cleaning effect, it has proven to be advantageous to form the bristle array with at least two circle segments. These circle segments usually have a center angle of at least 200°. The circle segments usually comprise bristle bundles concentric to the center point. Thus, each circle segment has one, preferably a plurality of concentrically arranged rings or partial rings of bristle bundles. The center of the circle segment can either be surrounded by an inner ring of bristle bundles at a small distance. Alternatively, a single bristle bundle may be present in the center point, surrounded by at least two further rings of bristle bundles. The outer ring of this arrangement is usually formed by the bristle bundles with a diameter of between 0.8 mm and 1.2 mm and/or by bristle bundles of microfilaments which are tapered to a tip at the usage ends of the bristle bundle.

The circle segments usually have inner rings formed by conventional bristle bundles, which can be formed by filaments with a diameter of between 5 and 8 mils. Usually only the outer ring is formed by small diameter and/or tapered microfilaments. However, it is also possible to form not only the outer edge but also the adjacent ring or ring segment wholly or partially by the small diameter or tapered microfilaments. Individual bristle bundles can consist exclusively of the microfilaments. A bristle bundle can also contain both conventional bristle filaments and tapered microfilaments. Bristle bundles formed from tapered microfilaments can also alternate with conventional bristle bundles in the circumferential direction. This does not necessarily mean that every first bristle bundle is formed in the circumferential direction like every third bristle bundle and between them the second and fourth bristle bundles. Rather, certain circumferential portions may have multiple bristle bundles formed of microfilaments and/or small diameter bristles and other circumferential portions may have bristle bundles formed of conventional bristle filaments.

A circle segment according to the preferred design discussed above has a center angle of at least 180°. The circle segment formed by bristle bundles with concentrically arranged bundles is therefore at least a semicircle. Furthermore, the angle of the center is at least 220°, further preferred 240° and especially preferred 280°.

According to another preferred design of the present invention, the brush head carries a first and a second bristle array. These bristle arrays are spatially separated from one another, i.e. macroscopically recognizable as separate bristled areas. One of the two bristle arrays is usually circular in shape and has between two and four rings of bristle bundles arranged around the center of the circle. The two bristle arrays have at their edges a plurality of bristle bundles with a diameter of between 0.8 mm and 1.2 mm and/or bristle bundles formed from microfilaments, the microfilaments each being tapered to a tip at their usage ends.

The filaments of these conventional bristle bundles can form a bristle bundle that is contoured on the usage side. In other words, the usage ends of the filaments of a single bristle bundle are located in different planes, wherein the plane is perpendicular to the direction in which the filaments extend. To satisfy this criterion, it is sufficient for two filaments of a bristle bundle to be of different lengths so that the usage ends of all bristle bundles are in either the first or second plane. The shortest bristle filament may have its usage ends below a plane in which the tapered microfilaments are still generally cylindrical. The shortest bristle filament of a conventional bristle bundle can also end above this plane. The longest bristle filament of a conventional bristle bundle can end below a plane up to which all the tapered microfilaments are cylindrical. The longest filament can also end above this plane. The contoured conventional bristle bundle should have a length spread of 1.05 to 1.2, preferably 1.1 to 1.15. The length spread defines the ratio of the longest bristle filament compared to the shortest filament of an identical bristle bundle.

When bristle arrays are arranged in at least two circle segments, the bristle bundle provided near the front free end of the brush head usually has a smaller outer diameter than the circle segment shaped bristle bundle displaced further back in the direction of the handle stem. The width of the brush head at the front end is correspondingly reduced. The brush head is preferably narrower at the front end than at the rear end of the brush head near the handle stem. The outer contour of the brush head should follow the contour of the bristles on the brush head. The brush head has correspondingly circle-segment-shaped brush head areas, each of which is equipped with the circle-segment-shaped bristle arrays. Thus the outer edge of the brush head follows the contour of the base area of the individual bristle arrays. The projection of the brush head, i.e. the clear distance between the bristle bundle at the outer edge of the bristle array and the edge of the brush head is in any case essentially identical in sections. In sections means here that the projection is constant at least with a center angle of at least 45°, preferably 60°, particularly preferably 80°. It goes without saying that there is a larger projection between individual bristle arrays formed as circle segments. Sometimes there are also webs between individual bristle arrays formed as circle segments, which extend transversely to the longitudinal extension of the handle stem and do not carry bristle bundles.

BRIEF DESCRIPTION OF THE DRAWINGS

Further details and advantages of the present invention result from the following description of an embodiment in connection with the drawing.

DETAILED DESCRIPTION OF THE INVENTION

Figure 1:
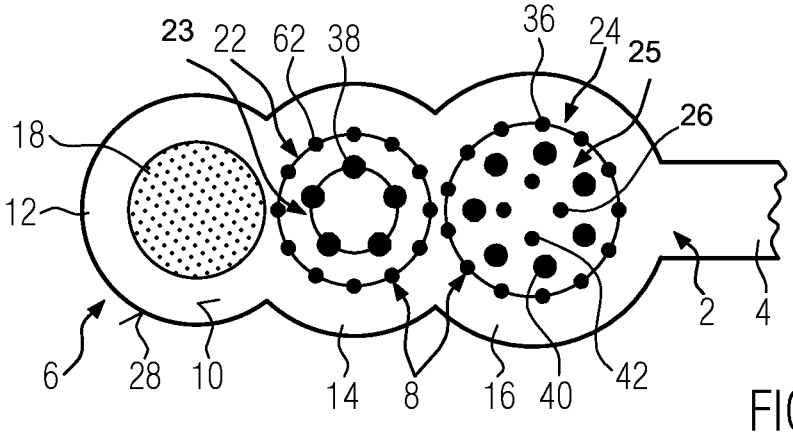
FIG. 1 shows a schematic top view of a brush head of a first embodiment of a toothbrush according to the invention.

FIG. 1 shows a first embodiment of a toothbrush having a base body 2 formed by a hard component, the base body 2 forming an incompletely shown handle stem 4 and a brush head 6 having a surface 10 projected through by bristle bundles 18. The bristle bundles, which are always marked with reference numeral 8, follow specific requirements which are explained in more detail below with reference to FIGS. 2 and 3.

The brush head 6 in the embodiment shown is formed by three basically circular and interlocking disc segments 12, 14, 16 whose diameter increases from front to back. The first disc segment 12 then has a smaller diameter than the second disc segment 14, which in turn has a smaller diameter than the third disc segment 16. The first disc segment 12 is equipped with a large circular bristle bundle 18, which is formed from conventional filaments with a diameter of 5 to 8 mils and is the only bristle bundle of the first disc segment 12.

The second and third disc segments 14, 16 are each provided with an arrangement of bristle bundles 8 arranged concentrically with respect to each other, wherein a bundle arrangement provided on the second disc segment 14 carries two circular bristle arrays 22, 23 and the third disc segment 16 carries three such circular bristle arrays 24, 25, 26. The respective outer circular bristle array 22 and 24 is formed by bristle bundles 36 having a diameter of between 0.8 and 1.2 mm and being formed of microfilaments having a diameter of not more than 6 mils. This outer bundle array 22, 24 concentrically surrounds bundle arrays 23, 25, and 26 which are formed by conventional bristle bundles 38, 40 and 42, respectively. The bristle filaments forming the bristle bundles 36 have a maximum length of 14 mm. The conventional bristle bundles are between 9 and 11 mm long. This length is measured from the surface 10 projected through by the bristle bundles to the ends of the bristle bundles on the usage end. In some embodiments, the bristle bundles 36, 50, 62 provided at the outer edge of the bristle array have filaments which are longer by a factor of 1.05 to 1.4 than the longest filaments of the remaining bristle bundles 38, 40, 42, 52, 54, 64 of the bristle array. Bristle bundles 38 and 40 also have a diameter of between 1.2 and 0.8 mm.

Figure 2:
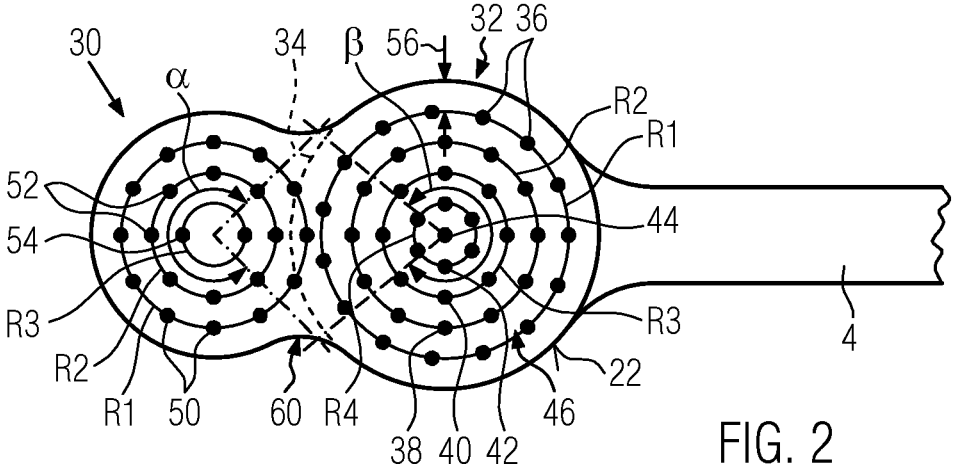
FIG. 2 shows a schematic top view of a brush head of a second embodiment of a toothbrush according to the invention.

In the top view according to FIG. 2, it can be seen that the brush head 6 has an approximately 8-shaped configuration, whereby the two disc segments 30, 32 forming this configuration have different diameters of the brush head 6. The diameter of the front disc segment 30 is smaller by a factor of 0.8 to 0.95 than the diameter of the rear disc segment 32. An imaginary circumferential line 34 completes this rear disc segment 32 to form a circular disc. Following the contour of the circular disc, a plurality of concentric rings R1 to R4 of bristle bundles 36, 38, 40, 42 are provided, which together with a central bristle bundle 44 form a first bristle array 46. The central bristle bundle 44 is the only bristle bundle in the center of this concentric arrangement of rings R1 to R4.

The front disc segment 30 is equipped with three rings R1 to R3 of bristle bundles 50, 52, 54 to form a second bristle array 48. As with the rear disc segment 32, the rings R1 to R3 are also provided concentrically to each other. The rings R1 to R3 are circular in each case. The innermost ring R3 has only two bristle bundles 54. The projection marked with reference numeral 56 in FIG. 2, i.e. the part of surface 10 of brush head 6 that protrudes beyond the outer ring R1 on the outside, is approximately 0.8 mm. This projection 56 is constant in the convex areas of a circumferential edge 28. In the area of a draw-in 60 of the brush head 6 there is no bristle bundle between the two bristle arrays 46, 48. The draw-in 60 forms an edge with a concave circumferential surface. The remaining part of the brush head 6 has a convex edge 28.

All bristle bundles form a cleaning-active surface of the toothbrush with their ends on the usage side. This cleaning-active surface is convexly curved for the first bristle array 46 in side view. In other words, the bristle bundles 36 to 44 of the first bristle array 46 central in the longitudinal extension have a greater length than the front and rear bristle bundles, independent of the assignment of the respective bristle bundles 36 to 44 to their respective rings R1 to R4. The front bristle array 48 is also curved in a corresponding manner, whereby this front bristle array forms a cleaning-active surface which rises slightly towards the front. The cleaning-active surface of the second bristle array 48 is inclined forward by about 10 to 20° in side view, so that the bristle bundles 50 to 54 arranged in longitudinal direction at the free end of the brush head 6 have a greater length than the bristle bundles of the second bristle array 48 arranged towards the first bristle array 46.

The cleaning-active surface of the second bristle array 48 is only slightly convex curved. Longitudinal sections through the second bristle array 48, i.e. sectional views transverse to the longitudinal extension of the handle stem 4, show a flat, cleaning-active surface formed by the second bristle array 48.

On the other hand, the first bristle array 46 also has a contouring in the cross-sectional view. The contouring is concave. In other words, the bristle bundles (e.g. 44) in the center of the cross-sectional view are shorter than the outer bristle bundles (e.g. 36 in a cross-sectional view through the center of the first bristle array 46). The outer bristle bundles protrude a few tenths of a millimeter (2/10 to 8/10 mm) beyond the central bristle bundles.

The bristle bundles 38-42 arranged on the rings R2 to R4 of the first bristle array 46 and also the bristle bundle 44 or the bristle bundles 50-54 arranged on the rings R2 to R3 of the second bristle array 48 are conventional. The conventional bristle bundles are all identically formed. The bristle bundles 36 and 50 arranged on the outer rings R1 each consist of microfilaments with a diameter of 6 mils, which are tapered at their usage ends. The usage ends of these microfilaments project beyond the usage end filaments of the remaining bristle bundles of the first and second bristle array 46, 48.

FIG. 2 shows a center angle of the front disc segment 30 with α. The angle α is about 270°. For the rear disc segment 32 a corresponding center angle is drawn with β. This center angle β is about 290°. The boundary lines of the front and rear disc segments 30, 32 intersect in the area of the draw-in 56.

The respective rings R1 to R4 or R1 to R3 are each designed as circumferentially closed rings. Thus the first and second bristle arrays 46, 48 each have a center angle of 360°.

Figure 3:
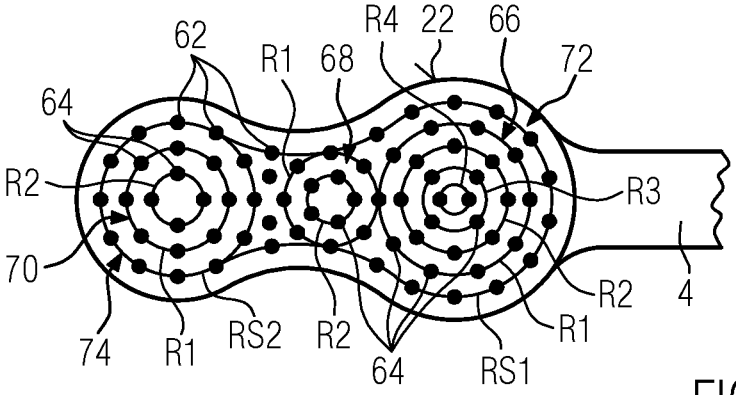
FIG. 3 shows a schematic top view of a brush head of a third embodiment of a toothbrush according to the invention.

While in the embodiment shown in FIG. 2 the bristle bundles formed from microfilaments are each completely provided as the last ring R1 of the two ring-shaped bristle arrays 46, 48, a slightly different design results for the embodiment shown in FIG. 3.

In this embodiment, the bristles have a wrapping of bristle bundles 62, which are formed by microfilaments with a diameter of 6 mils, wherein the microfilaments of the bristle bundles 62 are tapered to a tip at their usage end and are thus "tapered". Inner bristle bundles 64, surrounded by these outer bristle bundles 62, form a flat cleaning-active surface extending parallel to the surface 10. The ends of the outer bristle bundles 62 protrude over this cleaning active surface.

The bristle arrangement of the embodiment according to FIG. 3 shows three fully circumferentially provided circular bristle arrays 66, 68, 70 formed from the conventional bristle bundles 64. The circular bristle array 66 close to the handle stem is surrounded by outer bristle bundles 62 of microfilaments lying on a ring segment RS1 over a center angle of about 270°, so that a circle segment shaped bristle array 72 formed from the bristle bundles 62 of microfilaments and the conventional bristle bundles 64 with a center angle of 270° is obtained. A similar picture can be seen on the front bristle array 70, which realizes a circle segmented bristle array 72 formed by the outer bristle bundles 62 made of microfilaments which are only partially circumferentially provided. The outer bristle bundles 62, which are only partially circumferentially provided, lie on a ring segment RS2 with a center angle of 230°. The circle segment bristle array 74 has a center angle of 230°.

The central circular bristle array 64, formed by the conventional bristle bundles 60, has no outer bristle bundles 62, which are provided in the form of segments of a circle and formed of microfilaments, but two outer bristle bundles 62, formed of microfilaments, are located diametrically opposite each other on the outer ring R1 of the central bristle array 68.

In some embodiments, the bristle bundles 36, 50, 62 provided at the outer edge of the bristle array have filaments which are longer by a factor of 1.05 to 1.4 than the longest filaments of the remaining bristle bundles 38, 40, 42, 44, 52, 54, 64 of the bristle array.

Figure 4:
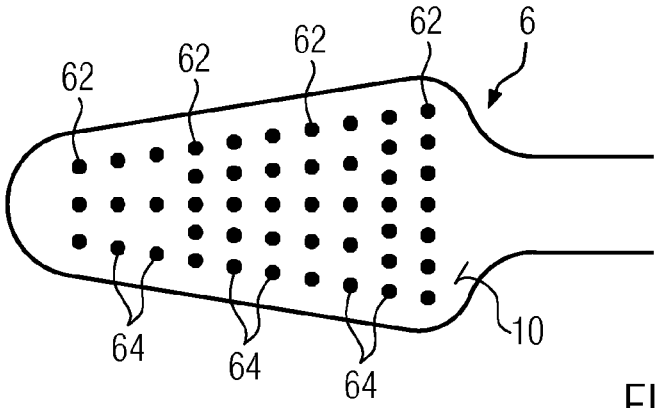
FIG. 4 shows a schematic top view of a brush head of a fourth embodiment of a toothbrush according to the invention.
Figure 5:
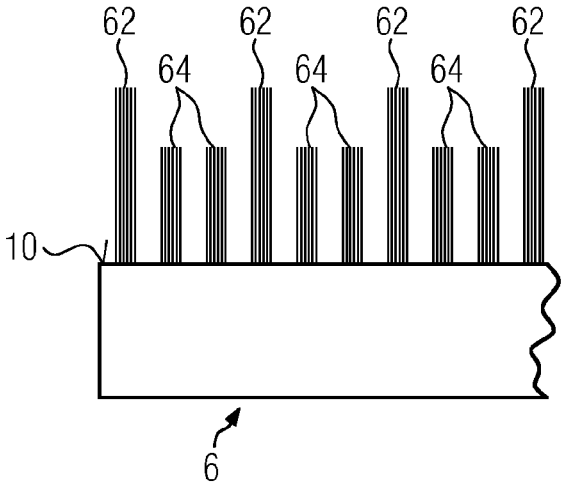
FIG. 5 shows a side view of the embodiment of a toothbrush according to the invention shown in FIG. 4.

In the embodiment shown in FIGS. 4 and 5, double rows of conventional bristle bundles 64 alternate with rows of bristle bundles 62 formed of microfilaments in the longitudinal direction of the handle stem 4, extending at right angles to its longitudinal extension. Their bristle bundles are also located at the outer edge of the bristle array. The diameters of the individual bristle bundles 62 are identical (0.8 mm to 1.2 mm). However, the bristle bundles formed from the microfilaments are longer, i.e. the distance between the ends of these bristle bundles 62 on the usage end is further away from the surface 10 projected through by the bristle bundles than the end of the conventional bristle bundles 64 (cf. FIG. 5). FIGS. 4 and 5 illustrate that between two relatively adjacent rows of microfilament bristle bundles 62 there are two parallel rows of conventional bristle bundles 64. The microfilament bristle bundles 62 have the same length and a much greater length than the conventional bristle bundles 64, whose diameter is between 1.5 and 1.9 mm.

Figure 6:
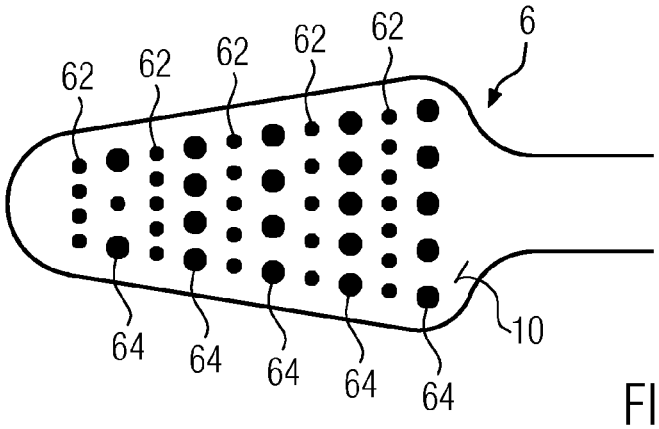
FIG. 6 shows a schematic top view of a brush head of a fifth embodiment of a toothbrush according to the invention.
Figure 7:
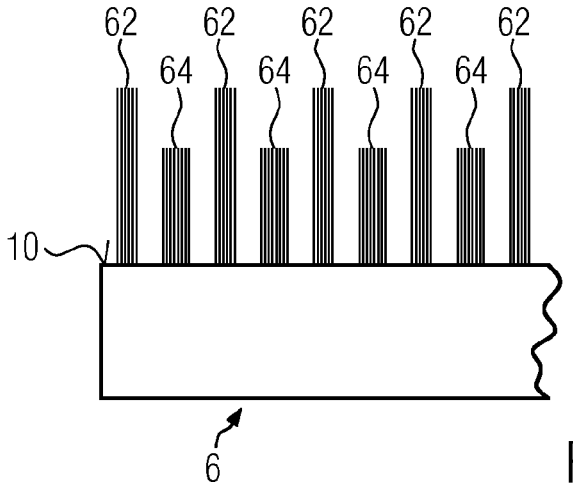
FIG. 7 shows a side view of the embodiment shown in FIG. 6.

FIGS. 6 and 7 show a modified embodiment with alternating rows of microfilament bristle bundles 62 and conventional bristle bundles 64. Here, too, the rows extend at right angles to the longitudinal extension of the handle stem 4. Each row of microfilament bristle bundles 62 is followed by a row of conventional bristle bundles 64. In this embodiment, too, the microfilament bristle bundles 62 are considerably longer than the conventional bristle bundles.

In the embodiments in FIGS. 4 and 7, bristle bundles 62 are a maximum of 14 mm long; bristle bundles 64 are between 9 and 11 mm long. Bristle bundles 62 in FIGS. 6 and 7 have a diameter of between 0.8 and 1.2 mm; bristle bundles 64 in FIGS. 6 and 7 have a diameter of between 1.5 and 1.9 mm. Bristle bundles 62 may have a length of between 11 and 14 mm; bristle bundles 64 may have a length of between 9 and 11 mm.

Figure 8:
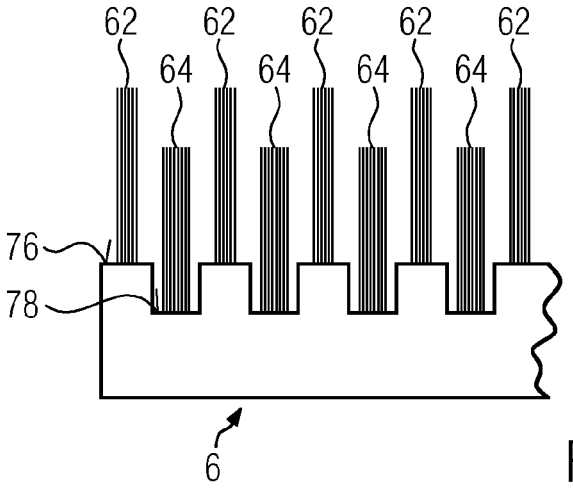
FIG. 8 shows a schematic side view of a sixth embodiment of a toothbrush according to the invention and FIG. 9 shows a longitudinal sectional view of an embodiment that is modified compared to FIG. 2.

FIG. 8 shows a modified embodiment of a surface topography of the brush head 6. In this surface topography the surface 10 projected through by the bristle bundles 62, 64 has a non-planar design. Thus the surface design is stepped according to the alternating arrangement of the different bristle bundles according to the embodiment in FIGS. 6 and 7. The bristle bundles 62 formed by the microfilaments project through a surface segment 76 which is considerably higher than a surface segment 78 projected through by the conventional bristle bundles 64. In principle, the bristle bundles formed by the microfilaments should be between 1.5 and 3 mm longer than the conventional bristle bundles 62. This difference in length refers to the distance between the ends of the bristle bundles 62 and 64 on the usage end relative to each other. Since the microfilaments of bristle bundles 62 are much less flexurally rigid, it has proved advantageous to choose the topography of surface 10 of the brush head 6 as sketched in FIG. 8. The bristle bundles 62 protrude over the brush head 6 by approximately the same length as the bristle bundles 64, and since the surface segments 76 are higher than the surface segments 78, even the microfilaments may be shorter in absolute length and still protrude at least 1.5 to 3 mm over the conventional bristle bundles 64.

Although FIG. 8 shows a stepped design, the surface 10 penetrated by the bristle bundles can also be wave-shaped, whereby the conventional bristle bundles 64 are provided in the wave troughs and the wave crests are projected through by the bristle bundles 62 formed by the microfilaments. This design prevents a shape of the surface 10 which favors the settling of dirt and bacteria.

The topography sketched in FIG. 8 can also be realized for the circular or circle-segmental shapes according to the embodiments in FIGS. 1 to 3. In this case the bristle bundles 36 of the embodiment in FIG. 2 are located on a higher surface segment than the conventional bristle bundles 38, 40, 42 located radially inwards.

Figure 9:
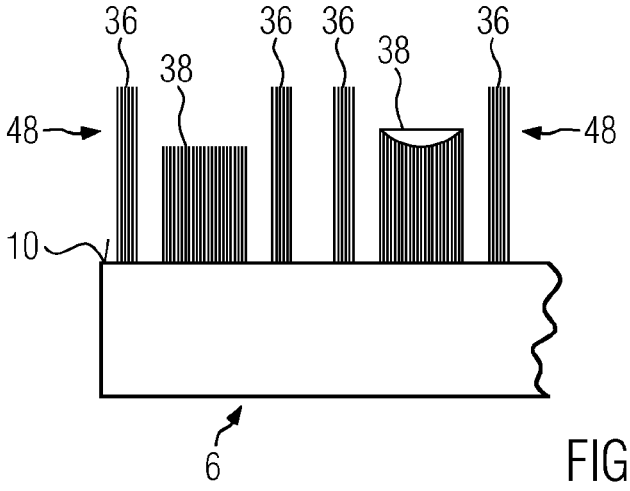

FIG. 9 shows an embodiment modified compared to FIG. 2. The embodiment has first and second bristle arrays 46, 48, which are designed as rings or ring segments in accordance with FIG. 2. The outer ring R1 of the respective bristle arrays 46, 48 is formed by bristle bundles 36, which are shaped identically to the bristle bundles 36 of the embodiment according to FIG. 1 and accordingly consist of tapered microfilaments. The bristle bundles provided within them are conventional and marked with reference numeral 38. They lie on inner rings R2 to R3 and R2 to R4 respectively. Similarly, all bristle filaments within the outer ring R1 may form a uniform bristle bundle as identified and described by reference to FIG. 1 with reference numeral 18.

The inner bristle bundles 38 of the first bristle array 46 form a concave shaped cleaning-active surface. Its lowest point is located in the center of the outer ring R1.

The bristle filaments of the second bristle array 48 lying within the outer ring R1 form a planar cleaning-active surface which extends substantially parallel to the surface 10 of the brush head 6, but lies below a plane in which the usage ends of the bristle bundles 36 lie on the outer ring R1.

The bristle bundles 36 lying on the outer ring R1 each have identical lengths, whereby the bristle bundles 36 of the first bristle array 46 have identical lengths as the bristle bundles 36 of the second bristle array 48.

In some embodiments, the bristle bundles 36, 50, 62 forming an outer edge of the bristle array 46, 48, 66, 68, 70 are provided between 0.8 and 1.2 mm away from the outer contour of the brush head 6.

LIST OF REFERENCE NUMERALS

2 base body
4 handle stem
6 brush head
8 bristle bundles
10 surface
12 first disc segment
14 second disc segment
16 third disc segment
18 bristle bundle
20 bundle arrangement
22 circular bristle array
23 circular bristle array
24 circular bristle array
25 circular bristle array
26 circular bristle array
28 edge
30 front disc segment
32 rear disc segment
34 imaginary circumferential line
36 bristle bundle
38 conventional bristle bundle
40 conventional bristle bundle
42 conventional bristle bundle
44 central bristle bundle
46 first bristle array
48 second bristle array
50 conventional bristle bundle
52 conventional bristle bundle
54 conventional bristle bundle
56 projection
60 draw-in
62 bristle bundle formed of microfilaments
64 conventional bristle bundle
66 circular bristle array near to the handle stem
68 central circular bristle array
70 circular bristle array remote to the handle stem
72 circular segment-shaped bristle array formed near the handle stem
74 circular segment-shaped bristle array formed near the handle stem
76 surface segment
78 surface segment
R1 ring
R2 ring
R3 ring
R4 ring
RS1 ring segment
RS2 ring segment

The invention claimed is:

1. A toothbrush having an elongate handle stem and a brush head connected to the handle stem, the brush head carrying a bristle array including a plurality of bristle bundles, wherein a plurality of bristle bundles arranged at an outer edge of the bristle array have a diameter of between 0.8 and 1.2 mm, or are formed from microfilaments with a diameter of 4 to 6 mils, or have a diameter of between 0.8 and 1.2 mm and are formed from microfilaments with a diameter of 4 to 6 mils, a usage end of the microfilaments being tapered to a tip, and wherein the brush head has a one-piece base body which forms a surface through which the bristle bundles project, and in that the bristle bundles having a diameter of between 0.8 and 1.2 mm, or formed of microfilaments having a diameter between 4 and 6 mils, or have a diameter of between 0.8 and 1.2 mm and are formed from microfilaments with a diameter of 4 to 6 mils, project through surface segments which are higher than those surface segments projected through by conventional bristle bundles formed from filaments having a diameter of 5 to 8 mils.

2. The toothbrush according to claim 1, wherein all the bristle bundles forming the outer edge of the bristle array have a diameter of between 0.8 and 1.2 mm and/or are formed from microfilaments with a diameter of 4 to 6 mils, which are tapered to a tip at their usage end.

3. The toothbrush according to claim 1, wherein the bristle bundles forming the outer edge of the bristle array are provided between 0.8 and 1.2 mm away from an outer contour of the brush head.

4. The toothbrush according to claim 1, wherein an edge of the brush head, which determines an outer contour of the brush head and extends at right angles from the surface through which the bristle bundles project, is provided at least partially with a soft-elastic overmolding.

5. The toothbrush according to claim 4, wherein the soft-elastic overmolding is formed in one piece with soft-elastic cleaning elements which project beyond the surface.

6. The toothbrush according to claim 4, wherein the soft-elastic overmolding forms a profiling shaped as a tongue cleaner on the surface through which the bristle bundles project.

7. The toothbrush according to claim 6, wherein the brush head carries a first and a second bristle array, wherein the first and the second bristle array are spatially separated from each other and have a plurality of bristle bundles respectively arranged at an outer edge of the respective bristle array which have a diameter of between 0.8 mm and 1.2 mm, or which are formed from microfilaments with a diameter of 4 to 6 mils and are tapered to a tip at usage ends of the microfilaments, or which have a diameter of between 0.8 and 1.2 mm and are formed from microfilaments with a diameter of 4 to 6 mils and are tapered to a tip at usage ends of the microfilaments.

8. The toothbrush according to claim 1, wherein the bristle array comprises at least two circle segments formed with a center angle ($\alpha$, $\beta$) of at least 200°, forming a uniform bristle array and formed of bristle bundles.

9. The toothbrush according to claim 8, wherein the circle segments comprise at least two bristle filament ring segments formed with a center angle ($\alpha$, $\beta$) of at least 200°.

10. The toothbrush according to claim 1, wherein the usage ends of the bristle filaments, which are tapered to a tip on the usage end, are dyed.

11. The toothbrush according to claim 1, wherein the bristle bundles provided at the outer edge of the bristle array have filaments which are longer by a factor of 1.05 to 1.4 than longest filaments of the remaining bristle bundles of the bristle array.

* * * * *